US008011697B2

(12) United States Patent
Adams et al.

(10) Patent No.: US 8,011,697 B2
(45) Date of Patent: Sep. 6, 2011

(54) METHODS OF USING SEMICONDUCTOR FABRICATION TECHNIQUES FOR MAKING IMAGERY

(75) Inventors: Jesse Adams, Reno, NV (US); Steven Malekos, Reno, NV (US); Grant Korgan, Reno, NV (US); Al Brandano, Kensington, NH (US)

(73) Assignee: Nanojewelry LLC, Reno, NV (US)

( * ) Notice: Subject to any disclaimer, the term of this patent is extended or adjusted under 35 U.S.C. 154(b) by 823 days.

(21) Appl. No.: 11/850,607

(22) Filed: Sep. 5, 2007

(65) Prior Publication Data

US 2008/0054624 A1 Mar. 6, 2008

Related U.S. Application Data

(60) Provisional application No. 60/842,442, filed on Sep. 5, 2006.

(51) Int. Cl.
*B42D 15/00* (2006.01)
*B42D 15/10* (2006.01)

(52) U.S. Cl. ..... 283/72; 283/67; 283/94; 283/98; 283/107; 283/109; 283/901

(58) Field of Classification Search ..... 281/51; 283/67, 72, 81, 85, 94, 98, 101, 107, 109, 283/117, 901
See application file for complete search history.

(56) References Cited

U.S. PATENT DOCUMENTS 5,644,352 A * 7/1997 Chang et al. ..... 283/67
7,435,979 B2 * 10/2008 Ryzi et al. ..... 283/85

OTHER PUBLICATIONS

"nano-American Flag/nano-White House," printed from "http://web.archive.org/web/20050310195111/http://www.research.cornell.edu/anmt/ANMT_files/Nano_Flag.pdf" (page dated Mar. 10, 2005).

* cited by examiner

*Primary Examiner* — Shelley Self
*Assistant Examiner* — Justin V Lewis
(74) *Attorney, Agent, or Firm* — Holland & Hart LLP

(57) ABSTRACT

Described herein are various embodiments of imagery or items comprising imagery using semiconductor processing or fabrication techniques and methods of using such techniques to make imagery. For example, according to one embodiment, a method of making imagery having nano-scale or micro-scale portions can include providing a silicon wafer, coating the silicon wafer with a layer of oxide, depositing a layer of photoresist onto the oxide layer, and removing a patterned portion of the photoresist to expose a patterned portion of the oxide layer. The method can also include removing at least some of the patterned portion of the oxide such that the patterned portion of the oxide layer has a predetermined thickness resulting in a predetermined viewable color. The patterned portion of the oxide layer can define at least one of the nano-scale or micro-scale portions.

22 Claims, 6 Drawing Sheets

METHODS OF USING SEMICONDUCTOR FABRICATION TECHNIQUES FOR MAKING IMAGERY

CROSS-REFERENCE TO RELATED APPLICATION

This application claims the benefit of U.S. Provisional Application No. 60/842,442, filed Sep. 5, 2006, which is incorporated herein by reference.

FIELD

The present application relates to semiconductor fabrication techniques, and more specifically to imagery using semiconductor fabrication techniques and associated methods.

BACKGROUND

Printing small images on consumer products using standard printing processes is known in the art. However, such printing processes can be limited in the amount of detail shown in the images printed and the smallest size of the images printed by the processes. Further, in applications where small images with smooth or reflective surface finishes are desired, it is often difficult to achieve such surface finishes with conventional printing processes.

SUMMARY

Described herein are various embodiments of imagery or items comprising imagery using semiconductor processing or fabrication techniques and methods of using such techniques to make imagery. For example, in one embodiment, an apparatus includes an object and a medium defining imagery that has a plurality of nano-scale or micro-scale portions. The medium can be coupled to the object and made using semiconductor processing techniques.

In certain implementations, each of the nano-scale or micro-scale portions can be selected from the group consisting of text and shapes.

In some implementations, the medium can include an oxide, such as silicon oxide, that has a predetermined thickness. The predetermined thickness can result in at least one of reflection, refraction, constructive interference, and destructive interference of light to produce a predetermined viewable color. In certain aspects, the oxide can include an outer surface that has at least one predetermined surface roughness. The at least one surface roughness can correspond to a predetermined viewable color intensity. Additionally, in specific implementations, the outer surface can include a plurality of portions that each has a different predetermined surface roughness. In yet certain aspects, the oxide can include a plurality of portions that each has a different predetermined thickness such that the imagery defined by the medium has a plurality of predetermined viewable colors. According to other aspects, at least some of the plurality of portions can have a shape selected from the group consisting of circle, square and rectangular to cooperatively produce an image that has a predetermined viewable color or shape.

In some implementations, the medium can include an oxide that has an outer surface with at least one predetermined diffraction grating pattern. The at least one predetermined diffraction grating pattern can correspond to a predetermined viewable color.

In certain implementations, the imagery can include a first image that is discernable to an unaided human eye and a plurality of second images that are undiscernable to the unaided human eye. The first image can include an artistic image and the plurality of second images comprises nano-scale or micro-scale text.

In some exemplary aspects, the object can be selected from the group consisting of pins, plaques, obelisks, gauges, clock faces, jewelry, trophies, paper weights and shipping containers. In certain implementations, the apparatus can also include a magnifying device that is coupled to the object. The device can be usable to view the plurality of nano-scale or micro-scale portions. According to another aspect, the text can form words with the text sized such that up to approximately 2,250,000 of the words fit within a 1-by-1 inch area.

According to one embodiment, a method of making imagery having nano-scale or micro-scale portions can include providing a silicon wafer, coating the silicon wafer with a layer of oxide, depositing a layer of photoresist onto the oxide layer, and removing a patterned portion of the photoresist to expose a patterned portion of the oxide layer. The method can also include removing at least some of the patterned portion of the oxide such that the patterned portion of the oxide layer has a predetermined thickness resulting in a predetermined viewable color. The patterned portion of the oxide layer can define at least one of the nano-scale or micro-scale portions. In some aspects, the silicon wafer is coupled to a consumer product.

In some implementations, removing at least some of the patterned portion of the oxide can include immersing the patterned portion of the oxide layer in an oxide remover a predetermined number of times for a predetermined amount of time.

In certain implementations, the patterned portion of the photoresist can include a first patterned portion of the photoresist. The remaining patterned portion of the oxide layer can include a first patterned portion that has a first predetermined thickness resulting in a first predetermined viewable color. The method can further include removing a second patterned portion of the photoresist to expose a second patterned portion of the oxide layer and removing some of the second patterned portion of the oxide layer such that the remaining second patterned portion of the oxide layer has a second predetermined thickness resulting in a second predetermined viewable color. The second predetermined thickness and color can be different than the first predetermined thickness and color.

In some implementations, the method can also include etching the exposed surface of the remaining portion of the patterned portion of the oxide layer to form a predetermined surface roughness on the exposed surface. In yet some implementations, the method can further include forming a diffraction grating pattern in the exposed surface of the remaining portion of the patterned portion of the oxide layer. The patterned portion of the silicon oxide layer can, in some implementations, include a plurality of nano-scale or micro-scale textual characters.

In certain implementations, the oxide can be a first oxide and the predetermined viewable color can be a first predetermined viewable color. The method can also include coating the silicon wafer with a layer of second oxide different than the first oxide. Additionally, the method can include removing a patterned portion of the photoresist to expose a patterned portion of the second oxide layer. According to specific implementations, the method can also include removing some of the patterned portion of the second oxide layer such that the remaining patterned portion of the second oxide layer has a predetermined thickness resulting in a second predetermined viewable color. The patterned portion of the second oxide layer can define at least one of the nano-scale or micro-scale portions.

According to another embodiment, an apparatus can include a consumer product and a silicon oxide wafer attached to the consumer product. The silicon oxide wafer can define nano-scale or micro-scale text. The thickness of the silicon oxide that defines the text can have a predetermined thickness that corresponds to a predetermined viewable color of the text and an outer surface of the silicon oxide that defines the text can have a predetermined surface roughness that corresponds to a predetermined light intensity of the predetermined viewable color. Each textual character of the text is sized to be undiscernable to the unaided human eye but discernable using a magnifying device. The thickness and surface roughness of the silicon oxide that defines the text can vary such that the text forms an artistic image discernable to the unaided human eye The foregoing and other features and advantages will become more apparent from the following detailed description, which proceeds with reference to the accompanying figures.

DESCRIPTION

Described herein are embodiments of an item having imagery made using semiconductor processing or fabrication techniques. The techniques are used to form an image comprised of one or more highly detailed nano- or micro-scale words, text or shapes on the product. Such imagery, or portions of such imagery, can be sized to be viewable by an unassisted human eye or viewable only through use of one or more vision assistance devices, such as a magnification device. The ability to produce such small and detailed, even microscopic, imagery on artistic or other products using semiconductor processing techniques results in a product with large amounts of text, words, images, or shapes that would not fit on the product using conventional techniques.

Examples of artistic and other products can include, but are not limited to, consumer products such as watches, clocks, gauges, jewelry, wall art, trophies, desk top displays, e.g., paper weights and other objects, such as an obelisk, car ornaments or gauges, key ornaments, or other various gems, instrumentation and novelty items. In some embodiments, the products can include an associated magnifier placed on and/or movable relative to the product to magnify various areas of the products.

Generally, as used herein, semiconductor processes or fabrication comprise one or more of the steps consisting of lithography, etching, thin film deposition using materials, such as, but not limited to, oxides, nitrides, metals, and precious metals, and/or any of various steps associated with other micromachining, microfabrication and nanofabrication processing steps of a semiconductor wafer or other material.

Figure 1:
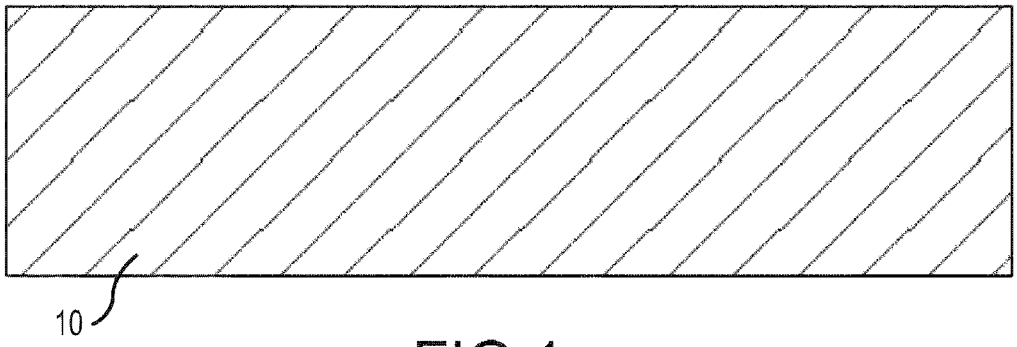
FIG. 1 is a side elevation view of a single crystal wafer according to one embodiment.

More specifically, according to one specific exemplary embodiment, the process of fabricating an artistic product having imagery, such as nano-scale imagery, formed thereon is shown in FIGS. 1-7. Referring to FIG. 1, the process can begin with a single crystal, i.e., mono-crystalline, wafer, such as silicon wafer 10. The silicon wafer 10 can be formed using conventional wafer forming and preparation techniques. Each wafer can be, for example, between about 0.4 mm (400 μm) and 0.75 mm (75 μm) thick and polished to obtain a regular and flat surface. Although the wafer shown and described is a silicon wafer, it is also recognized that other wafers, such as oxide wafers or sapphire wafers, can be used.

Figure 2:
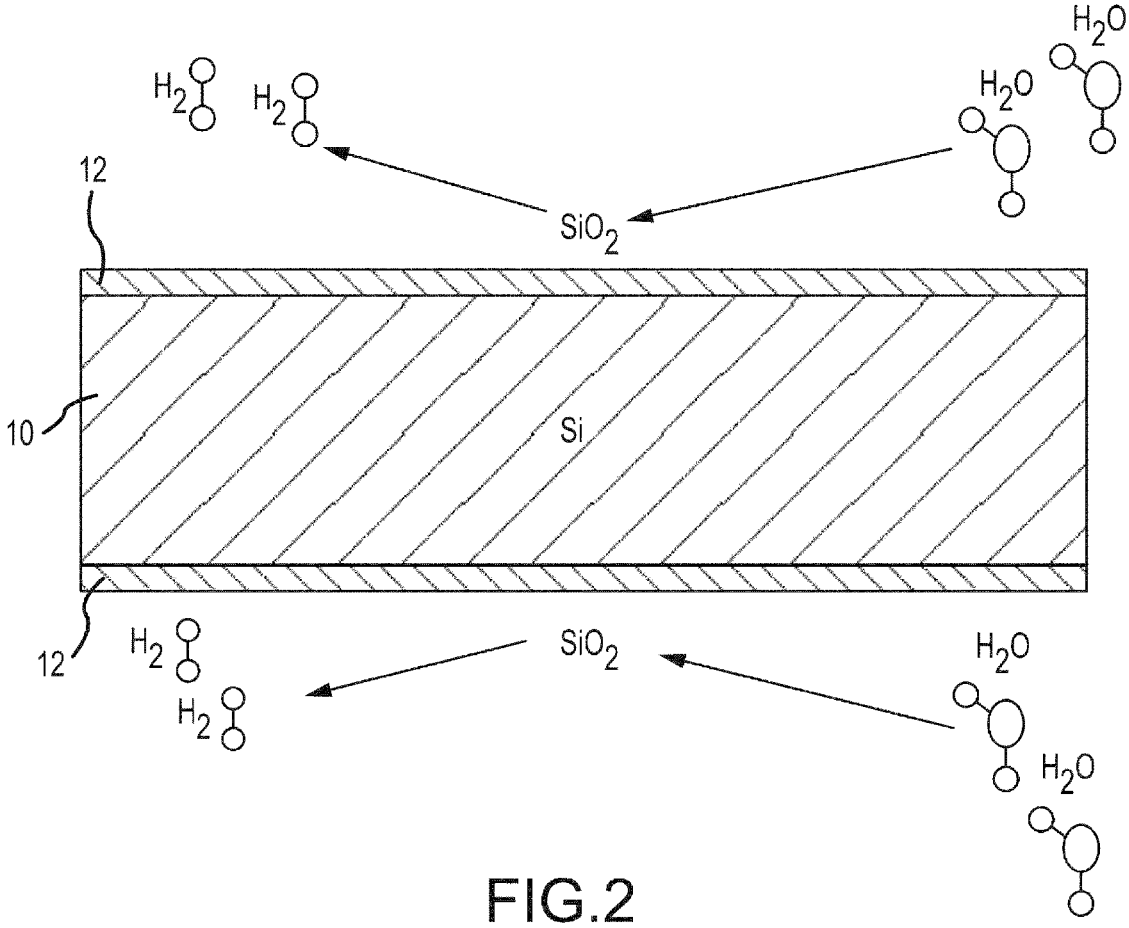
FIG. 2 is a side elevation view of the single crystal wafer being coated with a thin film of oxide according to one embodiment.

Referring to FIG. 2, the surfaces of the silicon wafer 10 can be coated with a thin film of oxide, such as silicon oxide 12 ($SiO_2$), by introducing water into a controlled environment having a high temperature, such as, for example, around 1100° C. The water interacts with the silicon to produce silicon oxide with hydrogen ($H_2$) as a resulting byproduct. In specific implementations, the thickness of the silicon oxide coating can be approximately 750 nm thick.

Figure 3:
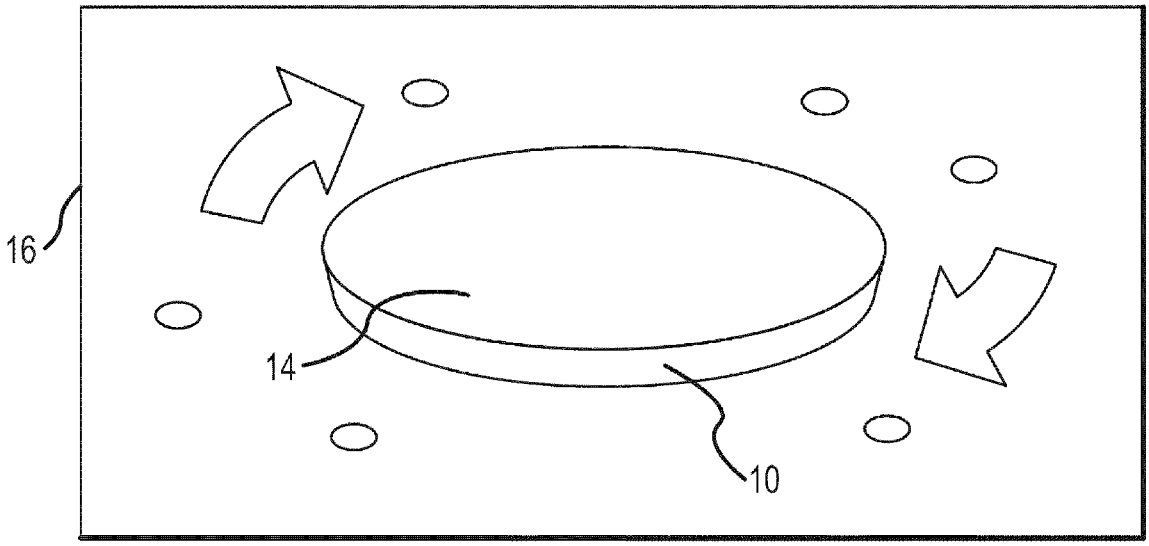
FIG. 3 is a perspective view of a coater for coating the wafer of FIG. 2.

Referring to FIG. 3, a major surface of the silicon wafer 10 is coated with a photoresist 14 using any of various deposition techniques known in the art, such as, but not limited to spin coating. In the example shown in FIG. 3, the photoresist is applied using a photoresist spin coater, such as coater 16 shown in schematic form, commonly known in the art.

Figure 4:
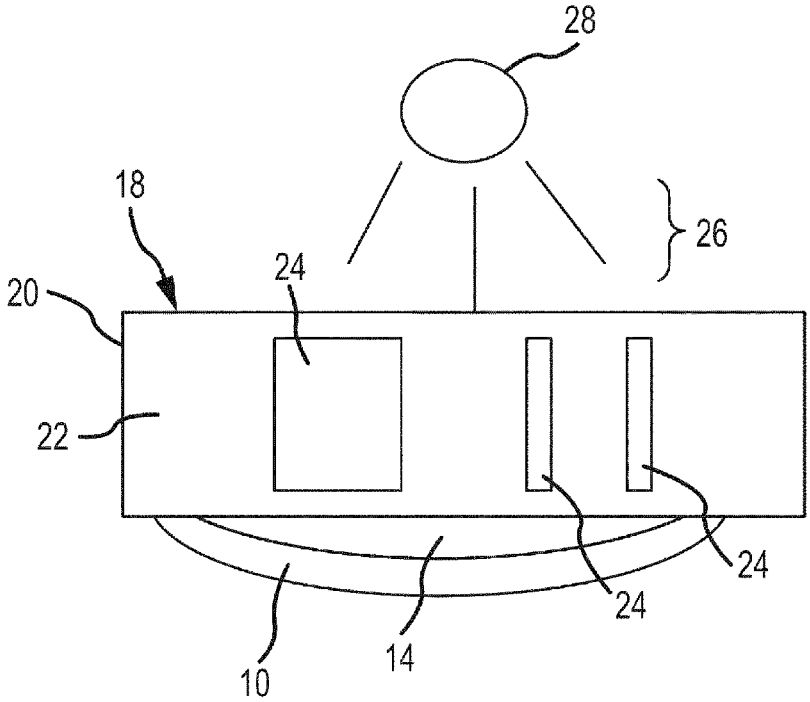
FIG. 4 is a perspective view of the wafer of FIG. 3 being patterned by a commonly known photolithography technique.

Referring to FIG. 4, the photoresist is patterned, or shaped, using commonly known photolithography techniques. For example, a mask 18 can be made of a quartz or glass plate 20 transparent to UV rays and an opaque material 22 or coating deposited or patterned on portions of the glass plate. The portions of the glass plate 20 not covered by or void of the opaque material 22 define a series of transparent windows 24, which together form a pattern to be duplicated on the wafer. The wafer 10, photoresist 14 and mask 18 are then exposed to short wavelength light, such as UV radiation 26, generated from a UV source, such as source 28.

Figure 5:
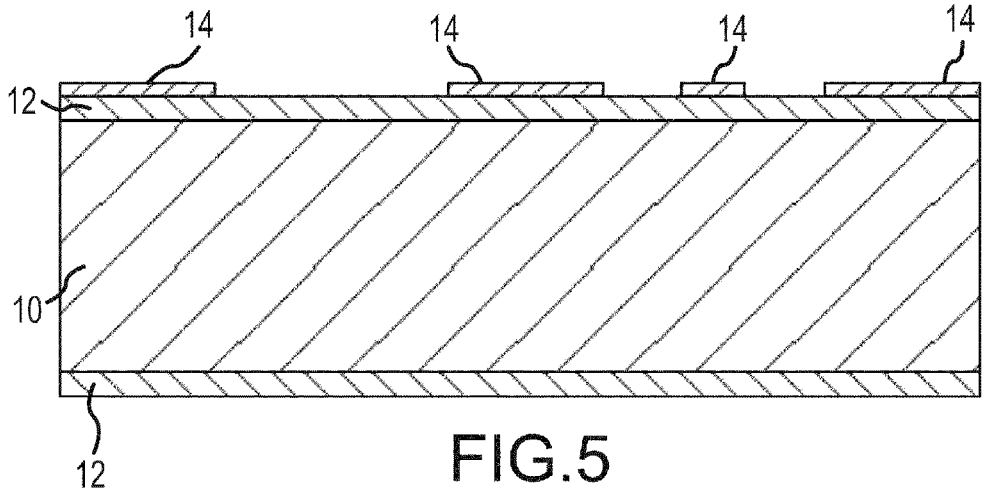
FIG. 5 is a side elevation view of the wafer of FIG. 4 shown having a developed layer of photoresist removed using a first material removal process.

Referring to FIG. 5, the mask 18 is removed and the wafer 10 is exposed to a first material removal process, such as wet etching, to remove the developed photoresist exposed to the UV radiation to expose portions of the silicon oxide 12 having the same shape or footprint as the pattern 24.

Figure 6:
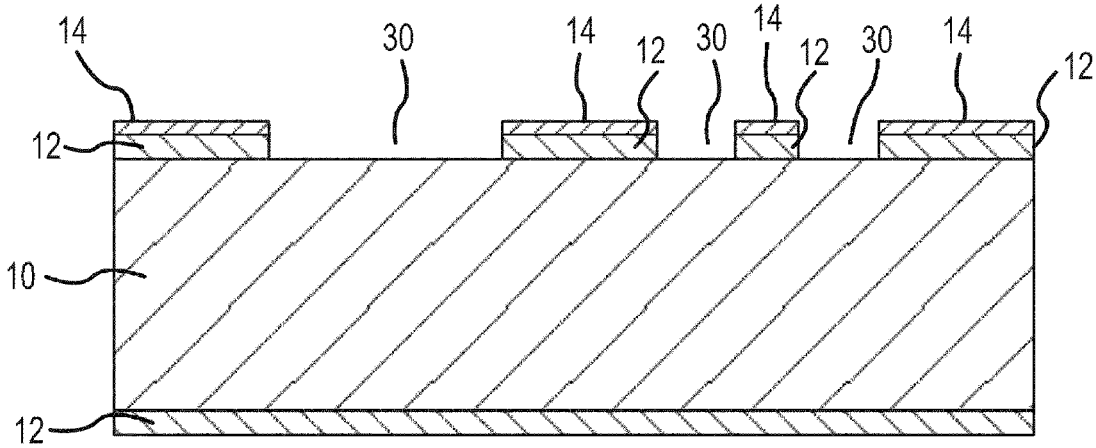
FIG. 6 is a side elevation view of the wafer of FIG. 5 shown having an exposed layer of silicon oxide removed using a second material removal process.

Referring to FIG. 6, the wafer 10 is then exposed to a second material removal process, such as an oxide etching process using a single or a series of timed hydrofluoric acid (HF) or buffered oxide etch (BOE) dips, to remove some or all of the exposed silicon oxide. The spaces, or voids, 30 resulting from the removal of silicon oxide define the pattern that will be viewable on the wafer 10. In one specific implementation, the BOE can consist of six parts of HF to one part of a buffer, such as ammonium fluoride ($NH_4F$). The buffer is included to maintain HF concentration and to control pH.

The number and timing of the hydrofluoric acid dips can be varied to etch the exposed silicon oxide to predetermined depths for producing silicon oxide layers of varying thicknesses. As will be described in more detail below, the thicknesses of silicon oxide layers can be varied to alter the characteristics of the image formed on the product.

Figure 7:
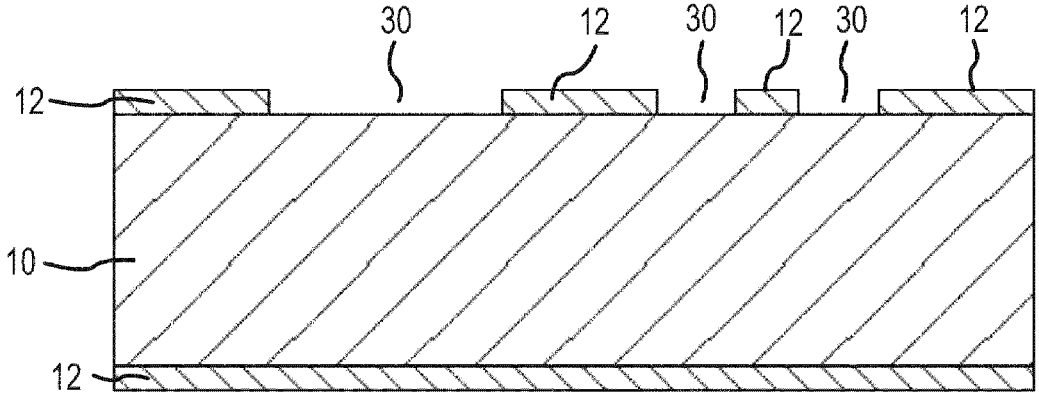
FIG. 7 is a side elevation view of the wafer of FIG. 6 shown having the undeveloped photoresist removed using a third material removal process.

Referring to FIG. 7, after the second material removal process, a third material removal process, such as exposing the wafer to a bath consisting of one or more of the following, acetone, EMT 130, sulfuric acid and hydrogen peroxide, cleans the wafer by removing the remaining photoresist from the wafer 10. Alternatively a plasma cleaning process can be used.

Following the third material removal process, the wafer, or partitioned portions of the wafer, is in a condition to form, or be coupled to, an artistic product. For example, in some embodiments, the wafer can be used as an artistic product itself, such as a wall fixture, watch face, gauge face, and a stationary or movable reflective surface for reflecting light. In specific implementations, for example, a reflective surface can be used (1) for light shows to reflect, for example, white light, specific colors of light and/or patterns of light; (2) as one or more reflective facets on a disco ball; or (3) as a reflective component on an object having reflective properties. In some embodiments, the wafer can also be cut into smaller pieces with each piece attached to or embedded in pins, display pieces, trophies, pendants, rings, class rings, or other jewelry and gems.

In some embodiments, two or more wafers and/or wafer pieces can be etched or cut into various shapes and sizes using the semiconductor fabrication processes discussed above or by a laser etching or cutting process. The etched or cut wafers and/or wafer pieces can be arranged relative to each other to create a collective piece of art. For example, two or more wafers or wafer pieces could be mounted to an object in a particular interrelated configuration to form a piece of art or product. More specifically, in certain embodiments, two or more wafers or wafer pieces can be mounted to an object at various elevations relative to each other to create a piece of art or product with 3-dimensional characteristics. Moreover, in some embodiments, the wafers and/or wafer pieces can be arranged in close proximity to each other, such as adjoining adjacent wafers and/or wafer pieces in a manner similar to a jigsaw puzzle, or in a space-apart relationship with each other.

As can be recognized, semiconductor fabrication techniques, as described above, allow a single wafer to comprise hundreds of identical or different individual images. The individual images can be cut and implemented in various products. Using such techniques for the high-volume production of nano- or micro-scale or macro-scale images can promote increased efficiency, decreased costs and economy in manufacturing compared with conventional printing techniques.

The semiconductor fabrication steps discussed above can provide etched surfaces of the wafer, e.g., spaces 30, that are smooth and reflective. Such smooth and reflective surfaces can efficiently reflect specific wavelengths of light through constructive or destructive interference to produce a specific color. In other words, color is produced by interference and not by the application of color pigments. The specific wavelength reflected, and thus the color produced, depends on the thickness of the silicon oxide.

Accordingly, the etching process can be customized to produce a silicon oxide thickness that corresponds with a desired color. In some embodiments, the thickness of the silicon oxide can range from about 100 nm to about 600 nm. However, it is recognized that in other embodiments, the thickness of the silicon oxide can be less than 100 nm or greater than 600 nm. The smooth and reflective nature of the etched silicon oxide or silicon surfaces produces colors with an enhanced brilliant and polished appearance. In some implementations, the semiconductor fabrication processes can be used to make a wafer having a silicon oxide layer with different or varying thicknesses to constructively or destructively reflect more than one wavelength and to produce more than one color. In other words, by varying the depth of the etched silicon oxide layer or layers on a single wafer from one location on the wafer to another, multi-color images, such as pictures or text, can be produced.

Figure 11:
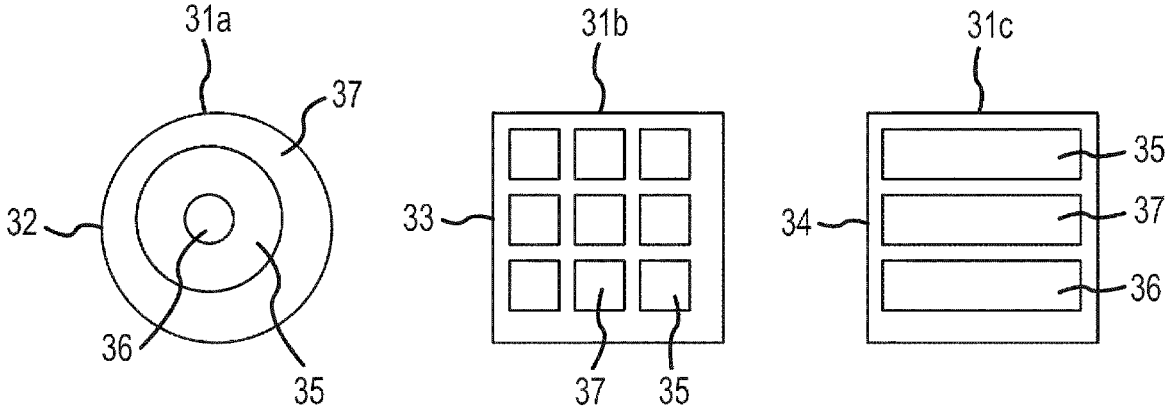
FIG. 11 are top plan views of several embodiments of a wafer each having a plurality of pixels.

Following the above-mentioned process, in specific embodiments, such as shown in FIG. 11, a single wafer can have an image that reflects small pixels of at least two colors. The pixels can be sized and arranged such that from a predetermined distance and/or angle, the reflected colors of the pixels combine to form a single intermediate color. For example, in some embodiments, images, or groups of patterned pixels, 31*a*, 31*b*, 31*c* can be created by grouping circle pixels 32, square pixels 33, and rectangular pixels 34. Each of the pixels 32, 33, 34 can reflect one of several colors, such as red 35, green 36 and blue 37, such that the colors combine to form an image, or portion of an image, having a single intermediate color at a predetermined distance away from the image.

Although the illustrated embodiments show circle, square and rectangular pixels, reflecting red, green or blue colors, it is recognized that in other embodiments, the pixels can have any of various other shapes, such as triangular or ovular, and constructively reflect one of other various colors, such as yellow and violet.

In addition to varying the thickness of the silicon oxide layer to reflect a specific color, the surface roughness of the silicon oxide layer can be varied, such as by plasma etching and/or chemical etching, to increase or decrease the intensity of the reflected light. As the intensity of the reflected light increases or decreases, the reflected light can vary in color or appearance to create multiple colored images at a given viewing distance.

In some embodiments, diffraction grating patterns can be created on the wafer to provide interesting and colorful images. For example, a series of patterned lines and adjacent spaces can be created on the wafer. The depth and width of the space, width of the line, and separation between adjacent lines can be adjusted to create different optical appearances.

In some embodiments, the wafer can be coated with an oxide other than silicon oxide or even another film. In these embodiments, the etched surface of the alternative oxide or film can reflect, refract or diffract light differently than silicon oxide in one or more places on the wafer.

In some embodiments, the wafer can be coated with more than one type of oxide or film. For example, a wafer could be coated with a layer of silicon oxide followed by a layer of an alternative oxide or film or vice versa. The outermost oxide layer could be subjected to a first oxide etching process using a first oxide etch and the innermost layer could be subjected to a second oxide or film etching process using a second oxide or film etch. The surfaces of the outermost and innermost layers of oxide or film can be etched to a predetermined depth such that each etched surface cooperatively reflects, refracts, and/or diffracts light differently depending on the film properties.

In yet other embodiments, it is recognized that the above principles can be applied to make a wafer that is coated with any number of oxide or film layers in any of various orders. Each layer can be etched using the above techniques to have any of various thicknesses. The layers of oxides and/or films can cooperate with each other to produce an image having a desired one of a variety of possible colors and appearances. For example one or more films or materials can be deposited that are not as reflective as the silicon surface. These films can be patterned or left as is to produce an artistic piece with variations in its reflectivity.

In one specific implementation, the pattern can include a plurality of spaces 30 (see FIG. 6) with each space defining a textual character, such as a letter, number, or punctuation mark, or a portion of a textual character or characters. The textual characters can be grouped together to form words, sentences and paragraphs.

In some implementations, one or more of the textual characters can be sized to be viewable by an unaided eye and one or more of the textual characters can be sized to require the assistance of a magnifier for viewing. In certain implementations, one or more of the textual characters can be sized such that they can be viewed using a low-powered magnifier, such as a magnifying glass. Yet in certain other implementations, one or more of the textual characters can be sized such that they can be viewed only through use of a medium or high-powered magnifier, such as an optical microscope or a scanning electron microscope. In another implementation, text can be organized in sentences and/or paragraphs with certain words or text being sized so as to be visible by the unaided eye or with a low power magnifier, and certain other words or text being sized so as to be visible only with a high power magnifier.

As can be recognized, many of the above implementations allow a significant volume of text or other indicia to be placed on a small surface area. Additionally, at least some of the implementations can provide products or artistic elements that elicit an emotional meaning. Moreover, in some of the implementations, a person is able to read at least some of the text or indicia by their unaided eye, which can lead a person to believe that a significant volume of text or indicia that may not be visible by the unaided is indeed patterned on the product or artistic element.

In some implementations, the text or other indicia may reflect different colors by patterning different words or letters with a different photo-mask and/or etching the film to a different depth as described above.

Referring back to FIG. 4, the windows, such as windows 24, forming the pattern on a mask, such as mask 18, can be, in some instances, less than 500 nm wide, such that the spaces, such as spaces 30, can also be less than 500 nm wide in some instances. As can be recognized, using semiconductor fabrication techniques to produce spaces, e.g., characters, lines and shapes, with widths as small as 500 nm allows for a significantly increased number of characters to fit within a small space compared to conventional printing techniques. Moreover, the images produced using the techniques described herein can be significantly more detailed and have a significantly higher resolution than images produced using conventional printing techniques. For example, in one implementation with characters or text having a height equal to 4000 nm, approximately 90,000 words can fit within a 5 mm by 5 mm space, and 2,250,000 words can fit within a 1 inch by 1 inch space.

Figure 8:
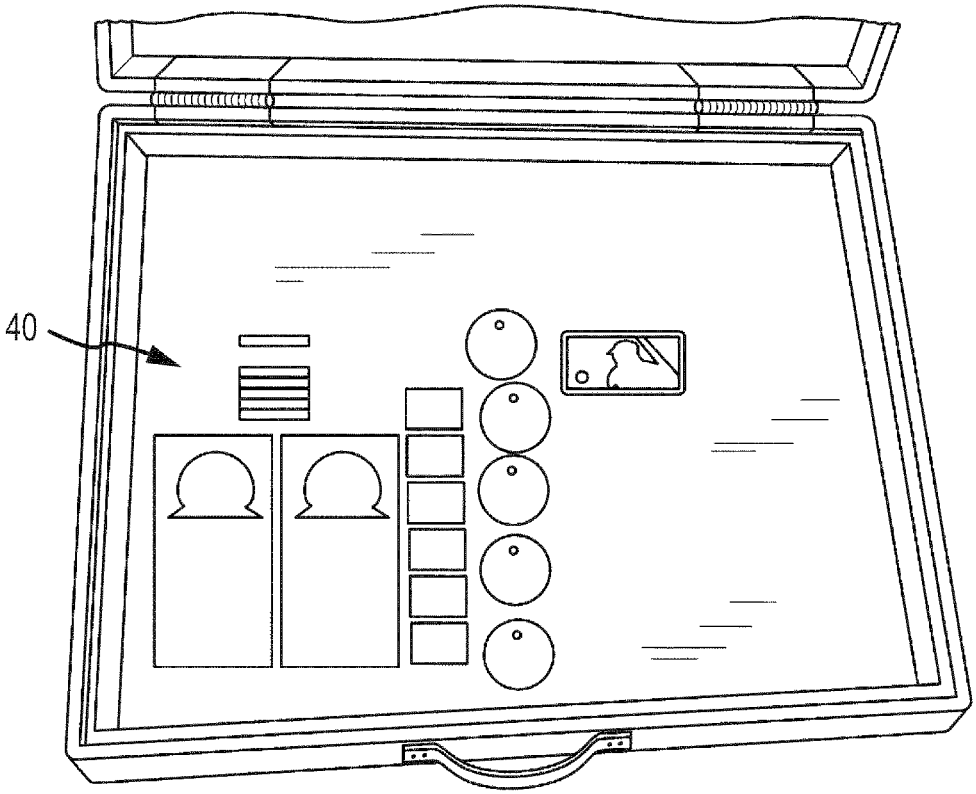
FIG. 8 is a perspective view of several embodiments of artistic products having imagery produced using semiconductor fabrication techniques.

Referring to FIG. 8, a grouping of exemplary artistic products 40, including mini-plaques and pins, is shown. Each product includes a portion with nano- or micro-scale imagery or text produced using semiconductor fabrication techniques.

Figure 9:
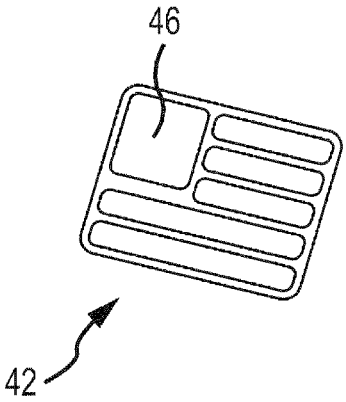
FIG. 9 is a perspective view of an embodiment of a pin having imagery produced using semiconductor fabrication techniques.
Figure 10:
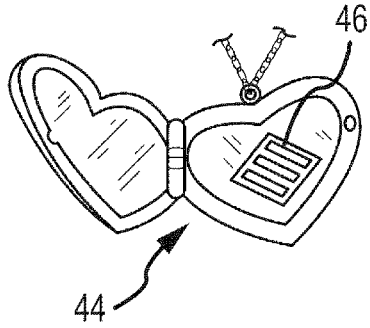
FIG. 10 is a perspective view of an embodiment of a piece of jewelry having imagery produced using semiconductor fabrication techniques.

Referring to FIGS. 9 and 10, an exemplary implementation of a pin 42 and piece of jewelry 44, respectively, are shown. The pin 42 and piece of jewelry 44 each have a gem 46 with an etched nano- or micro-scale image attached thereto. In some implementations, the gem 46 is one of a plurality of identical gems, or individual portions, cut from a single wafer.

The gem 46 can be attached to an artistic product, such as pin 42 and piece of jewelry 44, by any of various know attachment or bonding techniques. For example, a respective gem 46 can be attached to pin 42 and piece of jewelry 44 by applying an adhesive between the gem and the pin of piece of jewelry.

Figure 12:
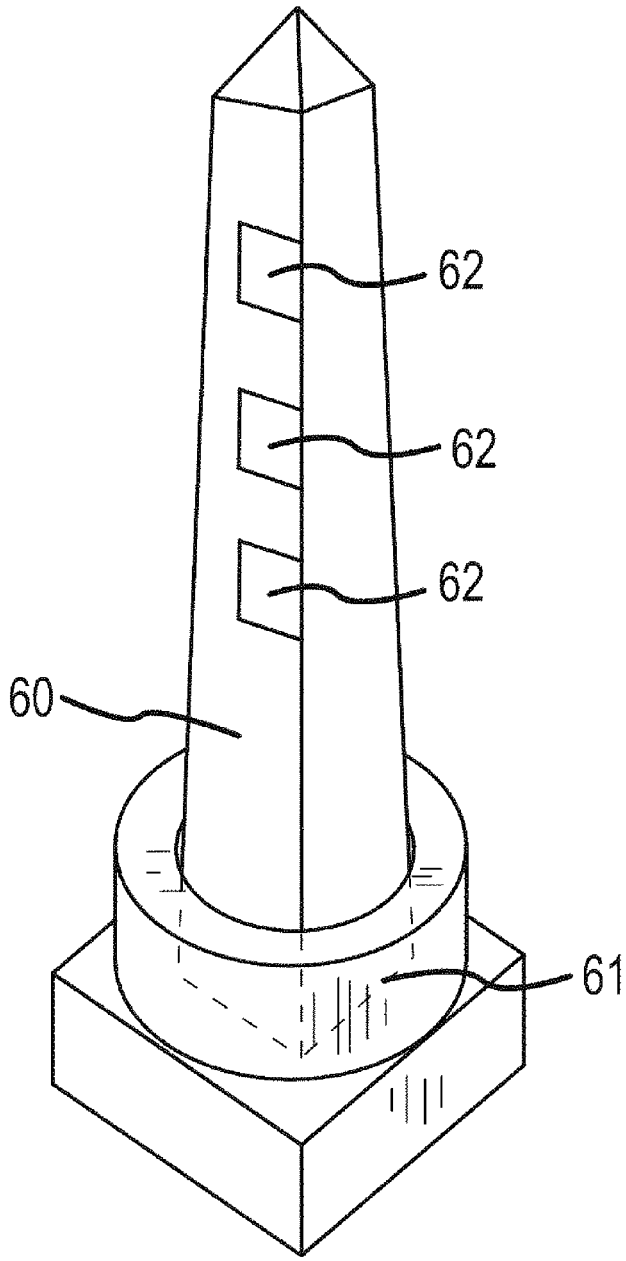
FIG. 12 is a perspective view of an obelisk having several gems each with imagery produced using semiconductor fabrication techniques.

In another exemplary embodiment, a product having imagery made using semiconductor processing or fabrication techniques can be an obelisk, such as obelisk 60 shown in FIG. 12, having one or more gems, such as gems 62, with an etched nano- or micro-scale image. The gems can be attached, mounted, embedded or otherwise coupled to the obelisk. For example, the obelisk 60 can be at least partially transparent and the gems 62 can be embedded within the obelisk and viewable from a position external to the obelisk.

The nano- or micro-scale image on the gems 62 can be viewable via an associated viewing device, such as viewer, or magnifier, 61. As shown in FIG. 12, the viewer 61 can have a cylindrical or annular shape that defines a central opening through which the obelisk 61 is extendible. The viewer 61 can be movable along the length of the obelisk 61 and held in place at a location on the obelisk adjacent one of the gems 62. A user can then look through the viewer 61 to view the imagery on the gem 62 adjacent the viewer. In alternative embodiments, the viewer can be fixedly mounted to or about the obelisk adjacent a gem for viewing imagery on the gem.

Imagery devices or products of the type disclosed herein may also be utilized in conjunction with a novel business method. The business method may provide imagery devices for a fee. Such devices may be custom made to order, or they may be pre-specified by the supplier and sold to order. The devices can include any of the types of images or indicia identified above.

The method may also include providing devices or systems for either viewing or otherwise confirming the images on or in the imagery devices. Example viewers can include a handheld view microscope, CMOS digital microscope, standard optical microscope, magnifying glass, fish-eye or bubble magnifier placed on or mounted over the imagery device or object containing the imagery device, scanning electron microscope, or access to an expensive scanning electron microscope. As mentioned above, the viewers can be sold with, or otherwise made available for use with, imagery devices, such as of the following type: art, gauges, clock faces, jewelry, pins, plaques, trophies, desk top displays, such as paper weights and other objects, such as obelisk 60 of FIG. 12, and other devices.

The method may also include providing certifications of content along with the image devices, either at the time of purchase or later. Providing such certifications can be done for a fee as well. The business model can, if desired, also include the sale of services to artists and other customers who would like to create imagery and/or text on this form of media. The artist can provide a computer file and the business model presented here would allow the business to transform the artist's file into appropriate photo-mask making files and create a wafer or more using these patterns. The artist can then, if desired, pay a fee up front and then the remaining fee after sale of the artistic piece. For art and other displays, the above exemplary principles provide an alternative to standard painting and printing currently known in the industry.

In view of the many possible embodiments to which the above exemplary principles may be applied, it should be recognized that the illustrated embodiments are only preferred examples and should not be taken as limiting the scope of the invention. Rather, the scope of the invention is defined by the following claims. We therefore claim as our invention all that comes within the scope and spirit of these claims.

We claim:

1. An apparatus, comprising:

an object; and a medium defining imagery having a plurality of nano-scale or micro-scale portions, the medium being coupled to the object;

wherein the medium comprises silicon oxide having a predetermined thickness; and wherein the medium is made using semiconductor processing techniques.

2. The apparatus of claim 1, wherein each of said portions is selected from the group consisting of text and shapes.

3. The apparatus of claim 1, wherein the predetermined thickness results in at least one of reflection, refraction, constructive interference, and destructive interference of light to produce a predetermined viewable color.

4. The apparatus of claim 3, wherein the oxide comprises an outer surface having at least one predetermined surface roughness, and wherein the at least one surface roughness corresponds to a predetermined viewable color intensity.

5. The apparatus of claim 1, wherein the medium comprises an oxide having an outer surface with at least one predetermined diffraction grating pattern, and wherein the at least one predetermined diffraction grating pattern corresponds to a predetermined viewable color.

6. The apparatus of claim 4, wherein the outer surface comprises a plurality of portions each having a different predetermined surface roughness.

7. The apparatus of claim 3, wherein the oxide comprises a plurality of portions each having a different predetermined thickness such that the imagery defined by the medium has a plurality of predetermined viewable colors.

8. The apparatus of claim 3, wherein at least some of the plurality of portions have a shape selected from the group consisting of circle, square and rectangular to cooperatively produce an image having a predetermined viewable color or shape.

9. The apparatus of claim 1, wherein the imagery comprises a first image discernable to an unaided human eye and a plurality of second images indiscernible to the unaided human eye.

10. The apparatus of claim 9, wherein the first image comprises an artistic image and the plurality of second images comprises nano-scale or micro-scale text.

11. The apparatus of claim 1, wherein the object is selected from the group consisting of pins, plaques, obelisks, gauges, clock faces, jewelry, trophies, paper weights and shipping containers.

12. The apparatus of claim 1, further comprising a magnifying device coupled to the object, wherein the device is usable to view the plurality of nano-scale or micro-scale portions.

13. The apparatus of claim 10, wherein the text form words, and wherein the text can be sized such that up to approximately 2,250,000 of said words fit within a 1-by-1 inch area.

14. A method of making imagery haying nano-scale or micro-scale portions, comprising:

providing a silicon wafer;

coating the silicon wafer with a layer of oxide;

depositing a layer of photoresist onto the oxide layer;

removing a patterned portion of the photoresist to expose a patterned portion of the oxide layer; and removing at least some of the patterned portion of the oxide such that the patterned portion of the oxide layer has a predetermined thickness resulting in a predetermined viewable color, wherein the patterned portion of the oxide layer defines at least one of the nano-scale or micro-scale portions.

15. The method of claim 14, further comprising coupling the silicon wafer to a consumer product.

16. The method of claim 14, wherein removing at least some of the patterned portion of the oxide comprises immersing the patterned portion of the oxide layer in an oxide remover a predetermined number of times for a predetermined amount of time.

17. The method of claim 14, wherein the patterned portion of the photoresist comprises a first patterned portion of the photoresist, and the remaining patterned portion of the oxide layer comprises a first patterned portion having a first predetermined thickness resulting in a first predetermined viewable color; and the method further comprising removing a second patterned portion of the photoresist to expose a second patterned portion of the oxide layer and removing some of the second patterned portion of the oxide layer such that the remaining second patterned portion of the oxide layer has a second predetermined thickness resulting in a second predetermined viewable color, wherein the second predetermined thickness and color is different than the first predetermined thickness and color.

18. The method of claim 14, further comprising etching the exposed surface of the remaining portion of the patterned portion of the oxide layer to form a predetermined surface roughness on the exposed surface.

19. The method of claim 14, further comprising forming a diffraction grating pattern in the exposed surface of the remaining portion of the patterned portion of the oxide layer.

20. The method of claim 14, wherein the oxide is a first oxide and the predetermined viewable color is a first predetermined viewable color, and the method further comprising:

coating the silicon wafer with a layer of second oxide different than, the first oxide;

removing a patterned portion of the photoresist to expose a patterned portion of the second oxide layer; and removing some of the patterned portion of the second oxide layer such that the remaining patterned portion of the second oxide layer has a predetermined thickness resulting in a second predetermined viewable color, wherein the patterned portion of the second oxide layer defines at least one of the nano-scale or micro-scale portions.

21. The method of claim 14, wherein the patterned portion of the silicon oxide layer comprises a plurality of nano-scale or micro-scale textual characters.

22. An apparatus, comprising:

a consumer product;

a silicon wafer attached to the consumer product and having a silicon oxide layer defining nano-scale or micro-scale text, wherein the thickness of the silicon oxide defining the text has a predetermined thickness corresponding to a predetermined viewable color of the text and an outer surface of the silicon oxide defining the text has a predetermined surface roughness corresponding to a predetermined light intensity of the predetermined viewable color; and a cylindrical magnifying device movably disposed around at least a portion of the consumer product;

wherein each textual character of the text is sized to be indiscernible to the unaided human eye but discernable using the magnifying device, and wherein the thickness and surface roughness of the silicon oxide defining the text varies such that the text forms an artistic image discernable to the unaided human eye.

* * * * *